US009671725B1

(12) United States Patent
Takahashi

(10) Patent No.: US 9,671,725 B1
(45) Date of Patent: Jun. 6, 2017

(54) TRANSFER DEVICE APPLYING A VOLTAGE FOR TRANSFERING A TONER IMAGE TO A MEMBER DISPOSED OPPOSITE A TRANSFER MEMBER WITH AN IMAGE CARRIER THEREBETWEEN

(71) Applicant: FUJI XEROX CO., LTD., Tokyo (JP)

(72) Inventor: Yoshinori Takahashi, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/087,138

(22) Filed: Mar. 31, 2016

(30) Foreign Application Priority Data

Dec. 18, 2015 (JP) ..... 2015-247818

(51) Int. Cl.
*G03G 15/16* (2006.01)

(52) U.S. Cl.
CPC ..... *G03G 15/1665* (2013.01)

(58) Field of Classification Search
CPC ..... G03G 15/1665; G03G 15/1675; G03G 15/1685; G03G 15/168
USPC ..... 399/66, 101, 313, 314
See application file for complete search history.

(56) References Cited

U.S. PATENT DOCUMENTS 8,270,886 B2 * 9/2012 Minbu et al. ..... G03G 15/1685 399/313
8,391,734 B2 * 3/2013 Minbu ..... G03G 15/161 399/101
8,929,760 B2 * 1/2015 Tanaka et al. ..... G03G 15/1675 399/101
2012/0321332 A1 12/2012 Yanagi et al.
2015/0117896 A1 4/2015 Sugimoto et al.

FOREIGN PATENT DOCUMENTS

| | | | |
|---|---|---|---|
| JP | 2002-116642 | A | 4/2002 |
| JP | 2005-308994 | A | 11/2005 |
| JP | 2006-330110 | A | 12/2006 |
| JP | 2009-031352 | A | 2/2009 |
| JP | 2009-151119 | A | 7/2009 |
| JP | 2013-003402 | A | 1/2013 |
| JP | 2014-240880 | A | 12/2014 |
| JP | 2015-111249 | A | 6/2015 |
| JP | 2015-161832 | A | 9/2015 |

OTHER PUBLICATIONS

Jul. 19, 2016 Office Action issued in Japanese Patent Application No. 2015-247818.
Nov. 15, 2016 Office Action issued in Japanese Patent Application No. 2015-247818.

* cited by examiner

*Primary Examiner* — William J Royer
(74) *Attorney, Agent, or Firm* — Oliff PLC

(57) ABSTRACT

A transfer device includes a transfer unit including an image carrier that carries a toner image to be transferred to a transfer surface of a recording medium, a transfer member disposed on a non-transfer-surface side of the recording medium, and an opposing member disposed opposite the transfer member with the image carrier therebetween; a scraping member that scrapes adhering matter from a surface of the transfer member by contacting the surface; a first application unit that applies a voltage, for transferring the toner image, to the opposing member; and a second application unit that applies to the transfer member a voltage having a polarity opposite to a polarity of the voltage applied by the first application unit.

7 Claims, 10 Drawing Sheets

| EVALUATION OF OCCURRENCE OF FILMING (TARGET VALUE ≤ G1) | | BACKUP ROLLER | | |
|---|---|---|---|---|
| | | GND | DC | AC |
| SECOND-TRANSFER ROLLER | GND | *** | G5 | G3 |
| | DC | G5 | G1 TO G2 | G0 |
| | AC | G3 | G0 | G0 *1 |

○: TARGET ACHIEVED,
△: PARTIALLY ACHIEVED,
(NO MARK): NOT ACHIEVED

FEW FILMING MANY
G0 G1 G2 G3 G4 G5

*1 CURRENTS IN COMBINATION OF "AC" AND "AC" HAVE OPPOSITE (DIFFERENT) POLARITIES.

: TONER
: CALCIUM CARBONATE

TRANSFER DEVICE APPLYING A VOLTAGE FOR TRANSFERING A TONER IMAGE TO A MEMBER DISPOSED OPPOSITE A TRANSFER MEMBER WITH AN IMAGE CARRIER THEREBETWEEN

CROSS-REFERENCE TO RELATED APPLICATIONS

This application is based on and claims priority under 35 USC 119 from Japanese Patent Application No. 2015-247818 filed Dec. 18, 2015.

BACKGROUND

Technical Field

The present invention relates to a transfer device and an image forming apparatus.

Paper dust, which is generated when a transfer member and a recording sheet contact each other, includes calcium carbonate particles (hereinafter, simply referred to as "calcium carbonate"). The calcium carbonate may deposit on a surface of the transfer member and form protrusions and recesses. If this occurs, the hardness of the transfer member and the surface roughness of the transfer member may deviate from their appropriate ranges, and a function of cleaning the transfer member may be negatively affected.

SUMMARY

According to an aspect of the present invention, a transfer device includes a transfer unit including an image carrier that carries a toner image to be transferred to a transfer surface of a recording medium, a transfer member disposed on a non-transfer-surface side of the recording medium, and an opposing member disposed opposite the transfer member with the image carrier therebetween; a scraping member that scrapes adhering matter from a surface of the transfer member by contacting the surface; a first application unit that applies a voltage, for transferring the toner image, to the opposing member; and a second application unit that applies to the transfer member a voltage having a polarity opposite to a polarity of the voltage applied by the first application unit.

BRIEF DESCRIPTION OF THE DRAWINGS

An exemplary embodiment of the present invention will be described in detail based on the following figures, wherein.

DETAILED DESCRIPTION

Exemplary Embodiment

Figure 1:
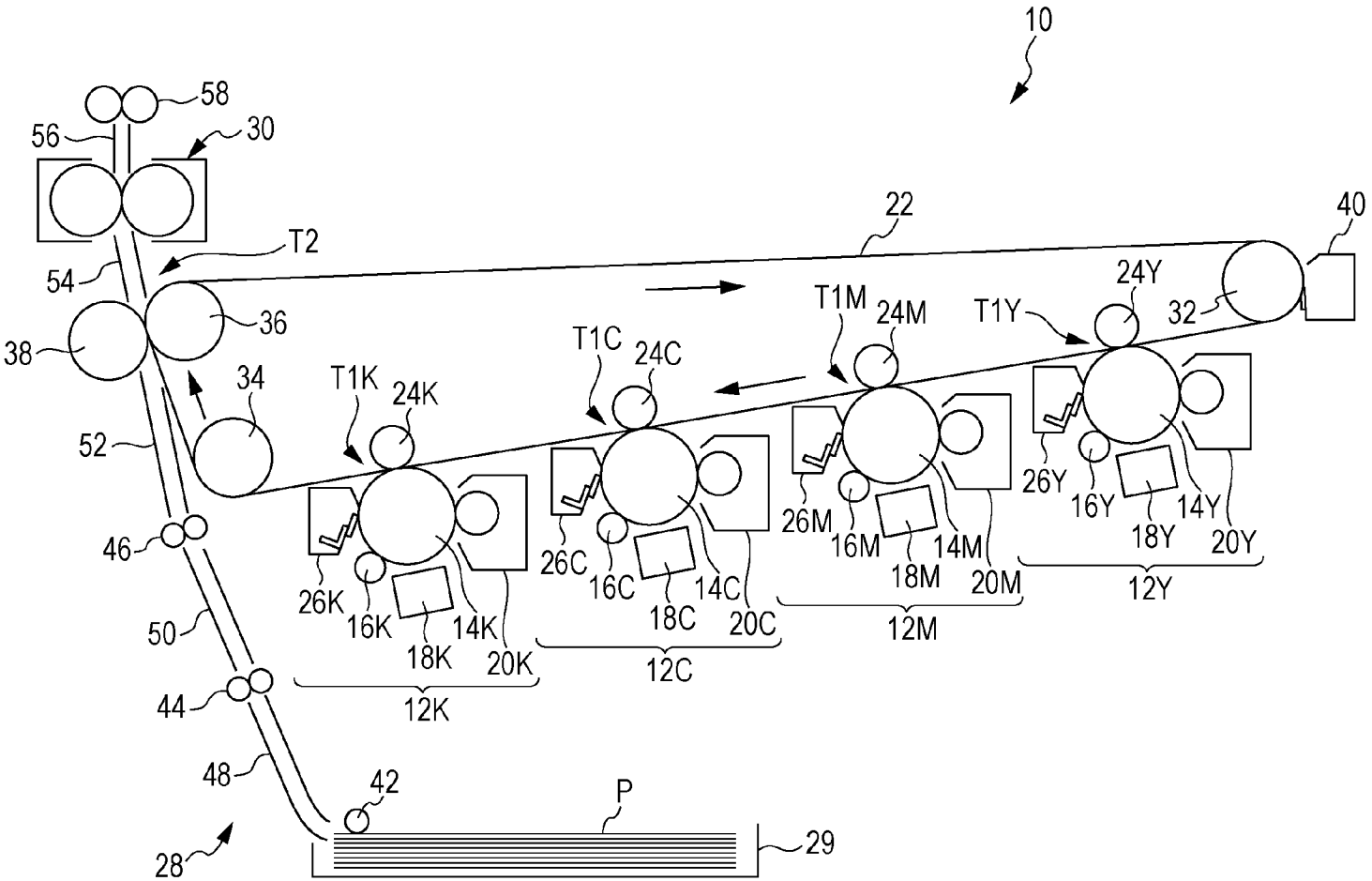
FIG. 1 is a front view of an image forming apparatus according to an exemplary embodiment.

FIG. 1 is a schematic view of an image forming apparatus 10 according to an exemplary embodiment.

The image forming apparatus 10 is a four-unit tandem image forming apparatus that is capable of forming a full-color image (also referred to as "printing"). The image forming apparatus 10 includes a first image forming unit 12Y, a second image forming unit 12M, a third image forming unit 12C, and a fourth image forming unit 12K, which respectively form a yellow (Y) image, a magenta (M) image, a cyan (C) image, and a black (K) image by using an electrophotographic method. The image forming units 12Y, 12M, 12C, and 12K are arranged in this order from the upstream side so as to be spaced apart from each other by a predetermined distance. In the following description, "image forming" and "printing" will be used synonymously.

The term "printing" will be used, for example, in "borderless printing", because it is more generally used than "borderless image forming".

In the following description, each of the first image forming unit 12Y, the second image forming unit 12M, the third image forming unit 12C, and the fourth image forming unit 12K will be referred to as the "image forming unit 12", because the four image forming units have the same structure. When it is not necessary to distinguish between corresponding components of the image forming units 12, the characters "Y", "M", "C", and "K" at the ends of the numerals of the components, which are shown in the figures, may be omitted in the description.

The image forming unit 12 includes a photoconductor drum 14, a charger 16, an exposure device 18, a developing device 20, and a cleaning device 26. The photoconductor drum 14 has photoconductor layer on a surface thereof. The charger 16 uniformly charges the photoconductor drum 14. The exposure device 18 irradiates the uniformly charged photoconductor drum 14 with light to form an electrostatic latent image. The developing device 20 forms a toner image by transferring toner to the latent image. The cleaning device 26 removes toner remaining on the photoconductor drum 14 after transfer.

The image forming apparatus 10 further includes an intermediate transfer belt (IBT) 22 and first-transfer rollers 24. The intermediate transfer belt (IBT) 22, which is an example of an image carrier, is an endless belt that is rotatably looped along a path that is in contact with the photoconductor drums 14 of the four image forming units 12. Each of the first-transfer rollers 24 transfers a toner image formed on a corresponding one of the photoconductor drums 14 to the intermediate transfer belt 22. The photoconductor drums 14 and the first-transfer rollers 24 face each other in first-transfer sections T1.

The image forming apparatus 10 further includes a recording sheet transport mechanism 28 and a fixing device 30. The recording sheet transport mechanism 28 transports a recording sheet P from a sheet tray 29. The fixing device 30 fixes a toner image onto the recording sheet P.

The intermediate transfer belt 22 is looped over a drive roller 32 that rotates the intermediate transfer belt 22; a tension roller 34 that adjusts the tension of the intermediate transfer belt 22; and a backup roller (BUR) 36, which is an example of an opposing member. The first-transfer rollers 24 are disposed inside the loop of the intermediate transfer belt 22.

A second-transfer roller (2ndBTR) 38, which is an example of a transfer member, is disposed opposite the backup roller (BUR) 36 with the intermediate transfer belt 22 therebetween. The second-transfer roller 38 transfers a toner image on the intermediate transfer belt 22 to a recording sheet P that is being transported by the recording sheet transport mechanism 28. The backup roller 36 and the second-transfer roller 38 face each other in a second-transfer section T2.

A toner removing device 40 is disposed opposite the drive roller 32 with the intermediate transfer belt 22 therebetween. The toner removing device 40 removes toner from the intermediate transfer belt 22 after the second-transfer roller 38 has transferred toner images from the intermediate transfer belt 22 to the recording sheet P.

The recording sheet transport mechanism 28 includes: a pick-up roller 42; transport rollers 44 and 46; paper guides 48, 50, 52, 54, and 56 that form a recording-sheet transport path; sheet-output rollers 58; and a sheet output tray (not shown). The recording sheet transport mechanism 28 transports a recording sheet P from the sheet tray 29 to a second-transfer position, where the second-transfer roller 38 and the backup roller 36 are disposed opposite each other with the intermediate transfer belt 22 therebetween. Then, the recording sheet transport mechanism 28 transports the recording sheet P from the second-transfer position to the fixing device 30, and from the fixing device 30 to the sheet output tray.

Engine Control System

Figure 2:
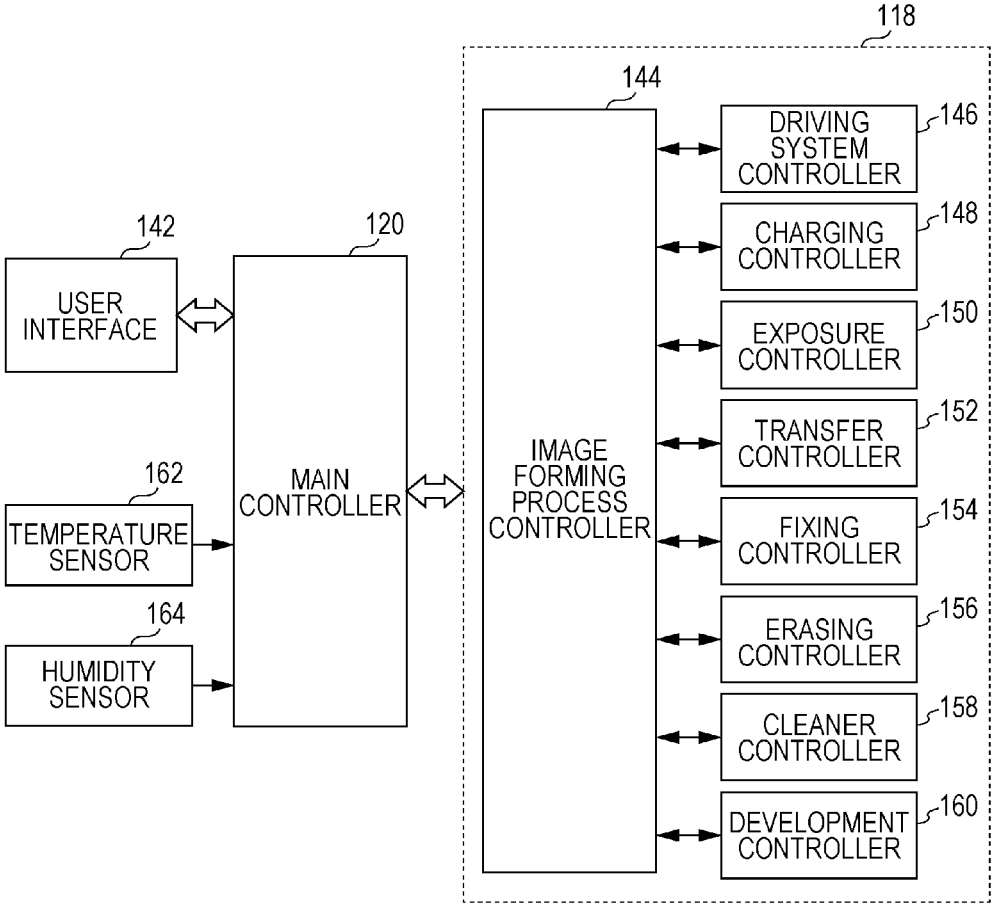
FIG. 2 is a control block diagram of an image forming process engine of the image forming apparatus according to the present exemplary embodiment.

FIG. 2 is a control block diagram illustrating an example of the control system of the image forming apparatus 10.

A user interface 142 is connected to a main controller 120 of the image forming apparatus 10. The user interface 142 includes an input unit, to which a user inputs a command related to an image forming operation or the like, and an output unit, which notifies information about an image forming operation or the like by using display or sound.

Image data is input to the main controller 120 through a network line, which is connected to an external host computer (not shown).

When image data is input, the main controller 120 analyses, for example, the image data and print command information included in the image data, converts the data format of the image data into a data format (for example, bitmap) that is compatible with the image forming apparatus 10, and feeds the converted image data to an image forming process controller 144, which functions as a part of an MCU 118.

On the basis of input image data, the image forming process controller 144 performs an image forming operation by synchronously controlling a driving system controller 146, a charging controller 148, an exposure controller 150, a transfer controller 152, a fixing controller 154, an erasing controller 156, a cleaner controller 158, and a development controller 160. Each of these controllers functions as a part of the MCU 118, as with the image forming process controller 144. In the present exemplary embodiment, the functions performed by the MCU 118 are divided into blocks. However, these blocks do not limit the hardware structure of the MCU 118.

A temperature sensor 162, a humidity sensor 164, and the like may be connected to the main controller 120. In this case, the temperature sensor 162 and the humidity sensor 164 detect the ambient temperature and the humidity of the inside of the housing of the image forming apparatus 10.

Borderless Printing

Typically, in an image forming process, an image forming region of a recording medium P is set so as to leave predetermined margins from the edges the recording sheet P.

However, the entire area of a recording sheet, without any margins, may be set as an image forming region. An operation of forming an image on a recording sheet P without leaving any margins may be referred to as "borderless printing".

In borderless printing, a toner image larger than the entire region of a recording sheet P (for example, 2 mm larger than each of the long side and a short side of an A4-sized recording sheet P) is formed on the intermediate transfer belt 22 in the first-transfer section T1, and the toner image is transferred to the recording sheet P in the second-transfer section T2.

Therefore, if toner is applied to an area of the intermediate transfer belt 22 beyond the edges of a recording sheet P and transferred to the second-transfer roller 38, as the second-transfer roller 38 rotates, the toner may leave smears on the back surface of the recording sheet P repeatedly in accordance with the rotation cycle of the second-transfer roller 38.

In the present exemplary embodiment, in order to efficiently remove toner and calcium carbonate adhering to the second-transfer roller 38, the surface roughness of the surface of the second-transfer roller 38 is adjusted by covering the surface with a resin film 60 (see FIG. 3) and by disposing a cleaning blade 62 (see FIG. 3) so as to be in contact with the surface of the second-transfer roller 38 (the resin film 60). The cleaning blade 62 functions as a cleaning member that mechanically removes toner (as described below in detail).

The resin film 60 prevents entry of toner and calcium carbonate into an elastic member 64 (see FIG. 3), which is a porous member of the second-transfer roller 38. Moreover, the cleaning blade 62 scrapes toner and calcium carbonate from the surface of the second-transfer roller 38 as the second-transfer roller 38 rotates.

On the peripheral surface of the second-transfer roller 38, so-called "filming", which is a phenomenon in which the calcium carbonate deposits on the surface of the second-transfer roller 38 and forms a thin layer adhering to the surface, may occur.

Figure 10A:
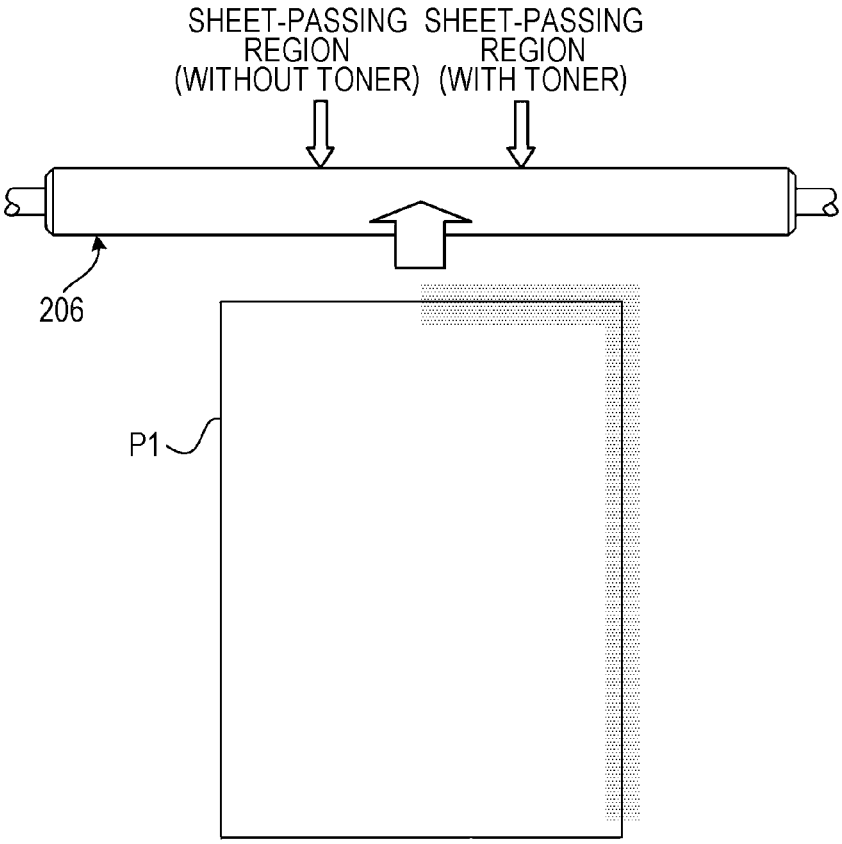
FIG. 10A is a plan view showing the positional relationship between a recording sheet and the second-transfer roller according to the comparative example.
Figure 10B:
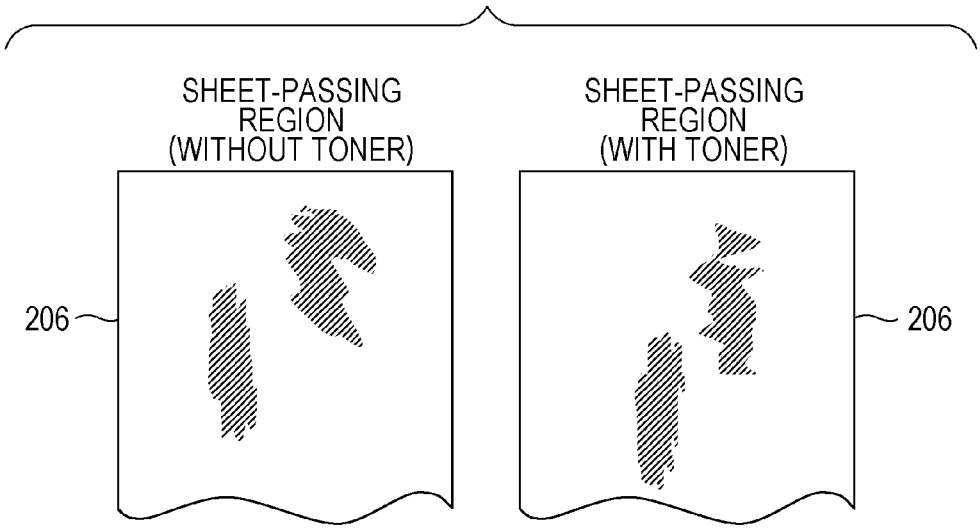
FIG. 10B is a development view of the second-transfer roller of FIG. 10A.

When filming occurs, paper dust (calcium carbonate), which is generated when a recording sheet P and the second-transfer roller 38 contact each other, forms thin-film spots on the peripheral surface of the second-transfer roller 38 and becomes visible (see the areas formed by diagonal lines in FIG. 10B). When filming of calcium carbonate occurs, the surface roughness and the hardness of the peripheral surface of the second-transfer roller 38 may fall out of appropriate ranges, which may cause a decrease of the cleaning function of removing toner from the second-transfer roller 38. Spots caused by filming may be more conspicuous if the spots include toner. The principle behind the occurrence of filming will be described below.

The exemplary embodiment, which has a structure with which the cleaning blade 62 scrapes toner and calcium carbonate off the surface of the second-transfer roller 38 as the second-transfer roller 38 rotates, additionally has a function of suppressing occurrence of filming in the second-transfer section T2.

Structure of Second-Transfer Section T2

Hereinafter, the structure of the second-transfer section T2, that is, the second-transfer roller 38 and the surrounding region will be described in detail.

Figure 3:
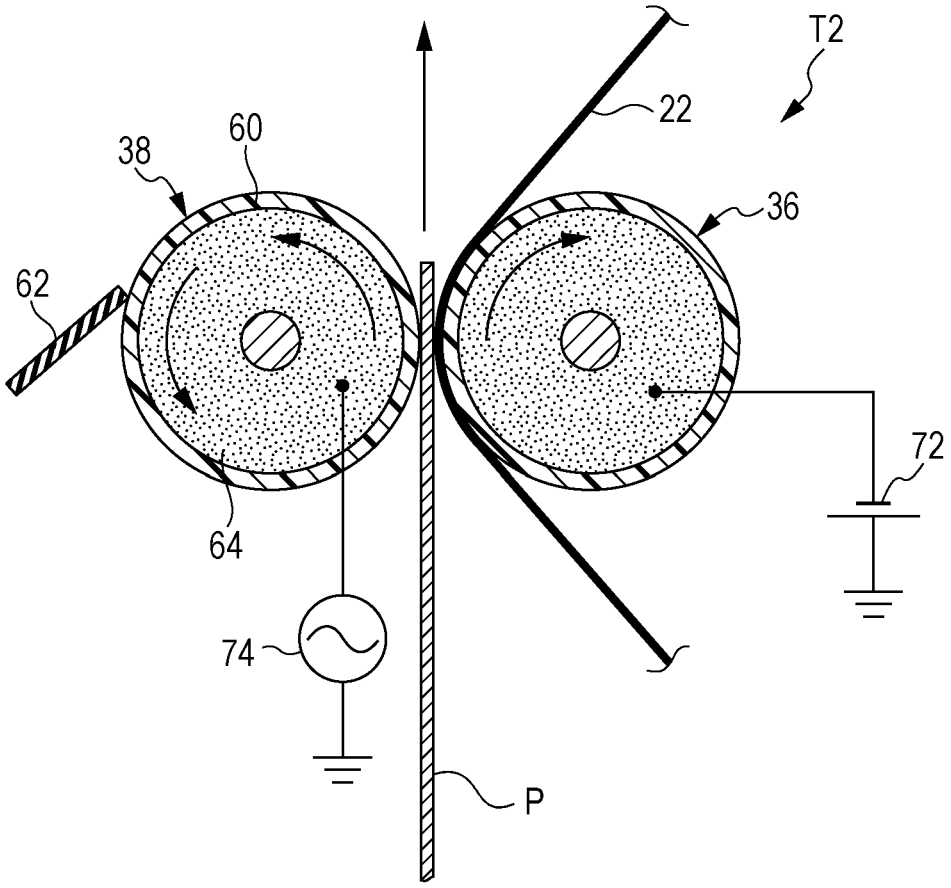
FIG. 3 is an enlarged view illustrating the structure of a second-transfer section according to the present exemplary embodiment.

FIG. 3 is an enlarged view of the second-transfer section T2, where the second-transfer roller 38 is in contact with the intermediate transfer belt 22, which is looped over the backup roller 36.

As described above, the second-transfer roller 38 is disposed opposite the intermediate transfer belt 22, which is looped over the backup roller 36. Second-transfer is performed when the recording sheet P passes through the nip between the intermediate transfer belt 22 and the second-transfer roller 38.

The second-transfer roller 38 includes a core and the elastic member 64, which is cylindrical and attached to the core. The elastic member 64 may be made of foamed polyurethane rubber, which is porous. Therefore, the surface of the elastic member 64 is rough and has a surface roughness Rz of 0.2 μm or greater.

The peripheral surface of the elastic member 64 is covered with the resin film 60. The resin film 60 may be made from a polyimide resin (PI) tube or a polyamide-imide resin (PAI) tube.

For example, the resin film 60 may have a hardness in the range of 30° to 40° and a surface roughness Rz in the range of 0.2 μm or less (Rz≤0.2).

In a transfer step, the resin film 60 serves to prevent entry of toner and calcium carbonate into the inside of the elastic member 64 and to hold toner and calcium carbonate on the surface of the second-transfer roller 38. Thus, it is easy to remove toner and calcium carbonate held on the surface of the second-transfer roller 38.

Mechanical Removal

The cleaning blade 62, for removing toner adhering to the second-transfer roller 38, is disposed so as to be in contact with the peripheral surface of the second-transfer roller 38. The cleaning blade 62 is an example of a scraping member.

The cleaning blade 62 is a plate-shaped blade that is made of an elastic material and has a predetermined thickness. The cleaning blade 62 is made of a material having appropriate mechanical properties, such as high wear resistance, high chipping resistance, and high creeping resistance. Examples of such a material include thermosetting polyurethane rubber.

The material of the cleaning blade 62 is not limited to polyurethane rubber and may be another functional rubber material, such as silicone rubber, fluorocarbon resin rubber, or ethylene propylene diene rubber.

The blade pressing method used in the present exemplary embodiment is a constant-displacement method, which may be implemented in a simple and low-cost structure. However, the blade pressing method is not limited to a constant-displacement method and may be a constant-load method, which generates a contact pressure that is substantially constant with time.

In the step of second-transferring an image to a recording sheet P, the cleaning blade 62 scrapes off toner adhering to a part of the surface of the second-transfer roller 38 beyond the edges of the recording sheet P, and thereby reduces toner smears on the back surface of the recording sheet P.

Paper dust (mainly composed of calcium carbonate), which is generated due to friction between the second-transfer roller 38 and a recording sheet P, may adhere to the second-transfer roller 38. The cleaning blade 62 scrapes off the calcium carbonate to maintain the roughness of the surface of the second-transfer roller 38 within a reference range (for example, Rz≤0.2 μm) to maintain its toner scraping function.

Electrical Removal (Reduction of Force of Adhesion of Calcium Carbonate)

In the second-transfer section T2, a direct-current power source 72 applies a direct-current voltage Vbur (having the same polarity as the toner potential) to the backup roller 36. The direct-current voltage Vbur is used to transfer a toner image on the intermediate transfer belt 22, which is composed of negatively charged toner, to a recording sheet P (shown in FIG. 1, but not shown in FIG. 3). The toner image is transferred to the recording medium P when the recording sheet P passes through the nip between the intermediate transfer belt 22 and the second-transfer roller 38. The direct-current power source 72 functions as a first application unit.

When the second-transfer roller 38 is rubbed against the back surface of the recording sheet P, paper dust (calcium carbonate) is generated and adheres to the second-transfer roller 38.

In borderless printing, toner is directly transferred to a part of the second-transfer roller 38 beyond the edges (in particular, the leading edge and the trailing edge) of a recording sheet P.

In the present exemplary embodiment, an alternating-voltage power source 74 applies an alternating voltage Vbtr to the second-transfer roller 38. The alternating voltage Vbtr is set by setting the values of predetermined parameters, which are frequency f, duty ratio, amplitude potential Vpp, and the average value Vave. The alternating-voltage power source 74 functions as a second application unit.

When the alternating voltage Vbtr, which is determined by the aforementioned parameters, is applied to the second-transfer roller 38, in relation to the polarity of the direct-current voltage Vbur applied to the backup roller 36, calcium carbonate that is to adhere to the second-transfer roller 38 vibrates (reciprocates) in the nip between the recording sheet P and the second-transfer roller 38.

In borderless printing, toner that is being transferred from the intermediate transfer belt 22 vibrates (reciprocates) in the nip between the intermediate transfer belt 22 and the second-transfer roller 38. However, in the following description, reduction of a force of adhesion of calcium carbonate will be specifically described.

The number of vibrations (the number of reciprocations) is adjustable by changing the alternating voltage Vbtr (predetermined frequency, duty ratio, Vpp, and Vave). In the present exemplary embodiment, the alternating voltage Vbtr is set so that the number of vibrations (the number of reciprocations) of toner is twice or more and six times or less (in the range of 2 to 6 times) when the toner moves in the nip width d (FIGS. 4A and 4B) between the intermediate transfer belt 22 and the second-transfer roller 38.

The number of vibrations n may be represented as the frequency of the alternating voltage Vbtr. The frequency f, which is the reciprocal of the period T (f=1/T) is represented as follows:

$$f=(n/d)\times v \tag{1}$$

where d is the nip width, and v is the peripheral velocity of the second-transfer roller 38 moving the nip width d.

Accordingly, the number of vibrations in the range of two to six is represented by the frequency f as follows:

$$\{(n2/d)\times v\}\leq f\leq\{(n6/d)\times v\} \tag{2}$$

where n2 denotes two vibrations, and n6 denotes six vibrations.

Note that the expression (1) is obtained by converting a period T to a frequency f as follows:

$$f=1/T=1/\{(d/n)/v\}=\{v/(d/n)\}=\{(n\times v)/d\}=(n/d)\times v.$$

That is, the frequency f for causing toner to vibrate twice within the nip width d is lower than the frequency f for causing toner to vibrate six times within the nip width d.

Exemplary Calculation

A simple example is as follows: when the nip width d between the intermediate transfer belt 22 and the second-transfer roller 38 is 1 mm and the peripheral velocity v of the second-transfer roller 38 is 100 mm/sec, toner adhering to the intermediate transfer belt 22 moves the nip width d in 0.01 seconds (d/v=1/100).

That is, the period T of two vibrations is (d/n2)/v, which is 0.005 seconds/cycle. Accordingly, the frequency f is the reciprocal (1/T), which is 200 Hz.

The period T of six vibrations is (d/n6)/v, which is 0.00166 . . . seconds/cycle (0.01 seconds/6 times). Accordingly, the frequency f is the reciprocal, which is 600 Hz.

In the above example, simple values are selected for ease of calculation. Note that these values are not necessarily suitable for an actual operation of the image forming apparatus 10.

The voltage is set so that toner vibrates (reciprocates) twice or more in the nip between the intermediate transfer belt 22 and the second-transfer roller 38 for the following reason: when a voltage for causing toner to reciprocate twice is applied, adhesion of calcium carbonate to the second-transfer roller 38 is suppressed, and occurrence of filming when the cleaning blade 62 cleans the second-transfer roller 38 is reliably prevented.

The voltage is set so that toner vibrates (reciprocates) six times or less in the nip between the intermediate transfer belt 22 and the second-transfer roller 38 for the following reason: when a voltage for causing toner to vibrate more than six times is applied, the frequency of the alternating voltage Vbtr is excessively high and the toner, which is to be used to form an image on a recording sheet P, may become scattered and may lead to decrease of image quality.

Hereinafter, an operation of the present exemplary embodiment will be described.

Ordinary Image Forming Process Mode

Because the image forming units 12 have substantially the same structure, the first image forming unit 12Y, which is disposed in an upstream region in the rotation direction of the intermediate transfer belt 22 and which forms an yellow image, will be described as a representative example. By respectively denoting components of the second to fourth image forming units 12M, 12C, and 12K by numerals to which magenta (M), cyan (C), and black (K) are attached instead of yellow (Y), description of the second to fourth image forming units 12M, 12C, and 12K will be omitted.

First, before starting the operation, the charger 16Y charges the surface of the photoconductor drum 14Y to a potential of −800 V in the present exemplary embodiment. Generally, the charging potential is selectable in the range of −600 V to −800 V.

The photoconductor drum 14Y includes an electroconductive metal body and a photoconductive layer formed on the metal body. The photoconductor drum 14Y normally has a high resistance. However, when a part of the photoconductor drum 14Y is irradiated with LED light, the resistance of the portion changes.

When image data for yellow is sent from the main controller 120 to the MCU 118, the exposure device 18Y emits an exposure light beam (such as an LED light beam) toward the surface of the photoconductor drum 14Y in accordance with the image data. The surface of the photoconductive layer of the photoconductor drum 14Y is irradiated with the light beam, and thereby an electrostatic latent image of a yellow printing pattern is formed on the surface of the photoconductor drum 14Y.

The electrostatic latent image is a so-called negative latent image formed on the surface of the photoconductor drum 14Y due to charging. The electrostatic latent image is formed because the resistivity of a part of the photoconductive layer irradiated with the light beam is reduced and charges on the surface of the photoconductor drum 14Y flow away while charges on a part of the photoconductor layer that is not irradiated with the light beam remain.

The electrostatic latent image, which is formed on the photoconductor drum 14Y as described above, is rotated to a development position as the photoconductor drum 14Y rotates. At the development position, the developing device 20Y develops the electrostatic latent image on the photoconductor drum 14Y into a visible image (toner image).

The developing device 20Y contains yellow toner, which is manufactured by using an emulsion polymerization method. The yellow toner, which is agitated in the developing device 20Y, is charged by friction to have the same (negative) polarity as the surface of the photoconductor drum 14Y.

As the surface of the photoconductor drum 14Y passes through the developing device 20Y, the yellow toner electrostatically adheres to only a part of a latent image on the photoconductor drum 14Y from which charges have been erased, and the latent image is developed by using the yellow toner.

As the photoconductor drum 14Y continues rotating, the toner image developed on the surface of the photoconductor drum 14Y is transported to a first-transfer position. When the yellow toner image on the surface of the photoconductor drum 14Y is transported to the first-transfer position, a first-transfer bias is applied to the first-transfer roller 24Y. Accordingly, the toner image receives an electrostatic force in the direction from the photoconductor drum 14Y toward the first-transfer roller 24Y to the toner image, and the toner image is transferred from the surface of the photoconductor drum 14Y to the surface of the intermediate transfer belt 22.

The transfer bias has the positive polarity, which is opposite to the negative polarity of the toner. For example, in the first image forming unit 12Y, the transfer controller 152 performs constant-current control to keep the transfer bias in the range of about +20 to 30 μA.

The cleaning device 26Y removes residual toner remaining on the surface of the photoconductor drum 14Y after transfer.

First-transfer biases applied to the first-transfer rollers 24M, 24C, and 24K of the second to fourth image forming units 12M, 12C, and 12K are controlled in the same way as described above.

The intermediate transfer belt 22, to which the first image forming unit 12Y has transferred a yellow toner image, passes through the second to fourth image forming units 12M, 12C, and 12K successively, and magenta, cyan, and black toner images are transferred in an overlapping manner.

After all the image forming units 12 have transferred all the color toner images to the intermediate transfer belt 22 in an overlapping manner, the intermediate transfer belt 22 is rotated in the direction of an arrow. Then, the color toner images reach the second-transfer section T2, including the backup roller 36, which is in contact with the inner surface of the intermediate transfer belt 22, and the second-transfer roller 38, which is disposed on the image-carrying-surface side of the intermediate transfer belt 22.

A feed mechanism feeds a recording sheet P to the nip between the second-transfer roller 38 and the intermediate transfer belt 22 at a predetermined timing, and a second-transfer bias is applied to the second-transfer roller 38.

The second-transfer bias has the positive polarity, which is opposite to the negative polarity of the toner. The toner images receive an electrostatic force from the intermediate transfer belt 22 toward the recording sheet P, and the toner images are transferred from the surface of the intermediate transfer belt 22 to the surface of the recording sheet P.

Subsequently, the recording sheet P is fed into the fixing device 30, which heats and presses the overlapping color toner images to fuse and permanently fix the toner images to the surface of the recording sheet P. After the color image has been fixed to the recording sheet P, the recording sheet P is transported to the output unit, and the color image forming process is finished.

Borderless Printing

In borderless printing, toner applied to an area beyond the edges of the recording sheet P may be transferred to the second-transfer roller 38 and may leave smears on the back surface of the recording sheet P. Moreover, calcium carbonate may be transferred from the recording sheet P to the second-transfer roller 38 and may cause so-called "filming".

To prevent these troubles, the elastic member 64, forming the peripheral surface of the second-transfer roller 38, is covered with the resin film 60, which is a PI tube, a PA tube, or the like. Moreover, the cleaning blade 62, which is disposed so as to be in contact with the second-transfer roller 38, scrapes (removes) toner and calcium carbonate from the second-transfer roller 38 as the second-transfer roller 38 rotates.

However, with mechanical removal performed by using the cleaning blade 62, calcium carbonate firmly adhering to the peripheral surface of the second-transfer roller 38 is not removed sufficiently and a part of the calcium carbonate remains on the peripheral surface. Accordingly, filming occurs due to pressure and frictional force generated by the cleaning blade 62, and therefore toner may not be reliably removed. The toner remaining on the surface of the second-transfer roller 38 may be transferred from the second-transfer roller 38 to the back surface of the recording sheet P again to leave toner smears on the recording sheet P and may considerably reduce the quality of the recording sheet P as a product.

Therefore, in the present exemplary embodiment, in order to reduce the force of adhesion of calcium carbonate to the second-transfer roller 38 (to prevent occurrence of filming), the alternating voltage Vbtr is applied to the second-transfer roller 38.

The alternating voltage Vbtr is set by setting the values of predetermined parameters, which are frequency f (1/period T), duty ratio, amplitude potential Vpp, and average value Vave.

When the alternating voltage Vbtr, which is determined by the aforementioned parameters, is applied to the second-transfer roller 38, in relation to the polarity of the direct-current voltage Vbur applied to the backup roller 36, the polarities of the recording sheet P and the second-transfer roller 38 alternate, and calcium carbonate that is being transferred from the recording sheet P to the second transfer roller 38 vibrates (reciprocates) in the nip width between the recording sheet P and the second-transfer roller 38.

In the present exemplary embodiment, the alternating voltage Vbtr is set so that the number of vibrations (the number of reciprocations) is twice or more and six times or less (in the range of 2 to 6 times).

Thus, with the present exemplary embodiment, by applying an alternating voltage to the second-transfer roller 38 to vibrate (reciprocate) calcium carbonate between the second-transfer roller 38 and the recording sheet P, it is possible to prevent occurrence of filming due to adhesion of calcium carbonate to the second-transfer roller 38.

The principle behind occurrence of filming will be described below before describing evaluations of the effect of preventing occurrence of filming by vibrating (reciprocating) calcium carbonate.

Principle behind Occurrence of Filming

FIGS. 8A to 9E illustrate a second-transfer section according to a comparative example. In the second-transfer section according to the comparative example, a direct-current power source 204 applies to a backup roller 202 a voltage having a negative polarity relative to the polarity of toner, and a second-transfer roller 206 is grounded.

In the second-transfer section, when a recording sheet P1 is inserted into the nip between an intermediate transfer belt 208 and the second-transfer roller 206, paper dust is generated by friction between the recording sheet P1 and the second-transfer roller 206. The paper dust is composed of particles of calcium carbonate, which is one of the materials of the recording sheet P1. The paper dust is transferred to the second-transfer roller 206 and adheres to the second-transfer roller 206 (see FIG. 8A).

For example, the particle diameter of toner used in the present exemplary embodiment is 4.8 μm, and the particle diameter of calcium carbonate is 1.0 μm. At least, the particle diameter of toner is greater than the particle diameter of calcium carbonate.

Figure 8A:
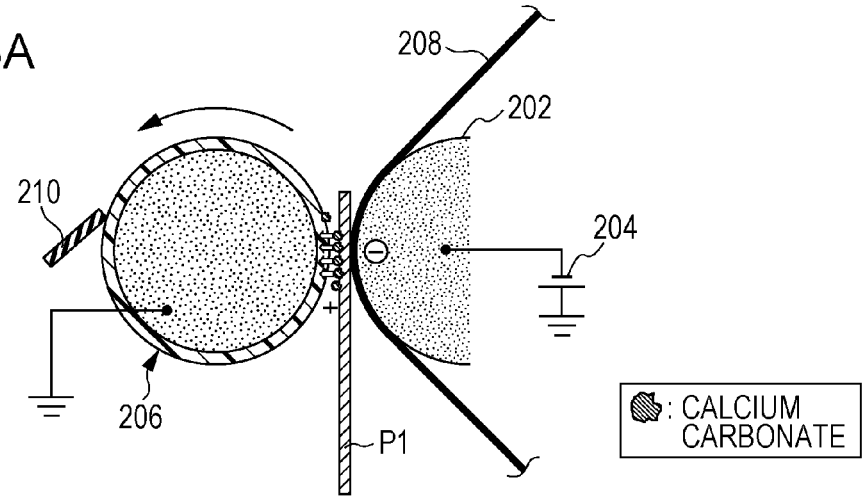
FIGS. 8A to 8C are enlarged views illustrating the structure of a second-transfer section according to a comparative example and showing the principle behind occurrence of filming, FIG. 8A illustrating the second-transfer section when a recording sheet starts passing through the second-transfer section, FIG. 8B illustrating the second-transfer section when the recording sheet finishes passing through the second-transfer section, and FIG. 8C illustrating the second-transfer section after the recording sheet has passed through the second-transfer section.
Figure 8B:
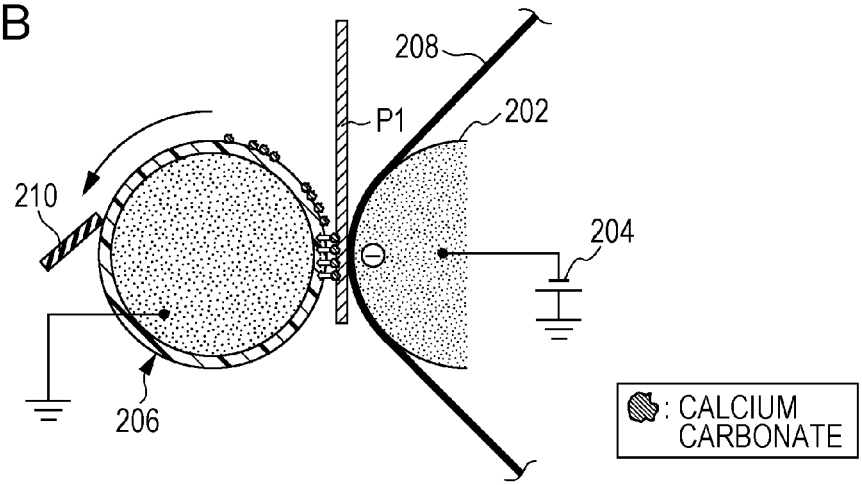

As the second-transfer roller 206 rotates, calcium carbonate adhering to the second-transfer roller 206 approaches a cleaning blade 210 (see FIG. 8B).

The cleaning blade 210 functions to remove toner that adheres to a part of the second-transfer roller 206 beyond the edges of the recording sheet P1 due to, for example, borderless printing. When calcium carbonate is mixed with the toner and reaches the cleaning blade 210, the calcium carbonate is crushed by receiving pressure and frictional heat from the cleaning blade 210 (see FIG. 8C).

Figure 8C:
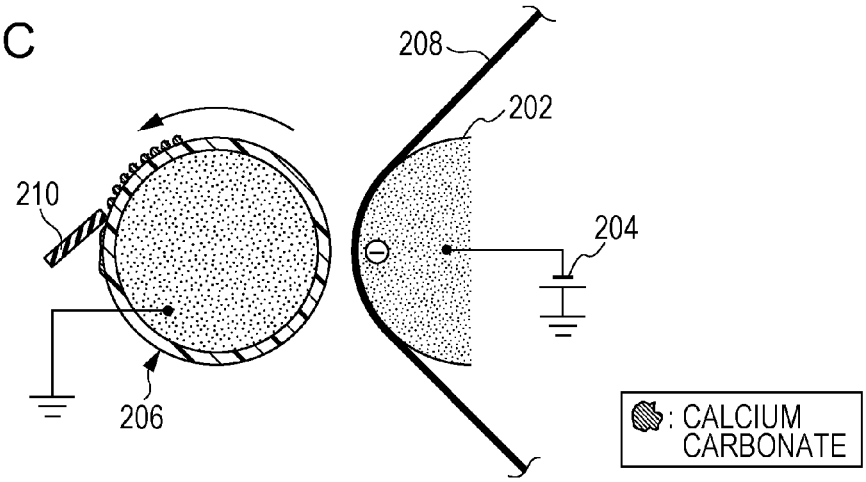

FIGS. 9A to 9E respectively show steps 1 to 5 of the process through which filming occurs in a contact region in which the cleaning blade 210 and the second-transfer roller 206 contact each other as the second-transfer roller 206 rotates in the state shown in FIG. 8C.

Step 1

Figure 9A:
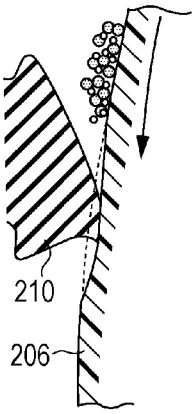
FIGS. 9A to 9E are enlarged views illustrating a contact region in which the second-transfer roller and the cleaning blade according to the comparative example are in contact with each other and showing the principle behind occurrence of filming, FIGS. 9A to 9E respectively showing step 1 to step 5 of the process through which filming occurs.

As shown in FIG. 9A, in the second-transfer section, calcium carbonate adhering to the second-transfer roller 206 and toner remaining on the second-transfer roller 206 due to borderless printing collide with the cleaning blade 210. The surface of the second-transfer roller 206 is pressed by the cleaning blade 210 and the surface of the second-transfer roller 206 is convexly deformed from that in a stationary state (see a dotted line in FIG. 9A).

Step 2

Figure 9B:
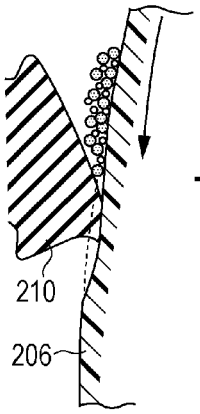

As shown in FIG. 9B, the calcium carbonate and the toner come into contact with an edge portion of the cleaning blade 210.

Step 3

Figure 9C:
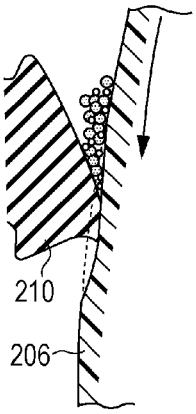

As shown in FIG. 9C, the calcium carbonate and the toner, which are pre-nipped by the cleaning blade 210, are crushed by receiving pressure and frictional heat from the cleaning blade 210.

Step 4

Figure 9D:
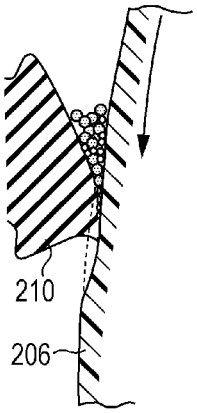

As shown in FIG. 9D, the calcium carbonate and the toner are crushed, and, mainly the calcium carbonate forms a thin film, which adheres to the second-transfer roller 206 and which may cause filming.

Step 5

Figure 9E:
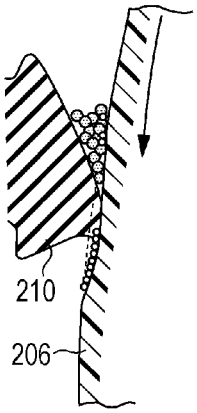

As shown in FIG. 9E, filming occurs as the calcium carbonate adhering to the second-transfer roller 206 becomes visible.

FIG. 10A shows an exemplary experiment that is performed to examine occurrence of filming in a first sheet-passing region and in a second sheet-passing region when a recording sheet P1 passes through the second-transfer roller 206. The first sheet-passing region is a region in which toner is not present in an area beyond the edges of the recording sheet P1. The second sheet-passing region is a region in which toner is present in an area beyond the edges of the recording sheet P1 due to borderless printing.

FIG. 10B is a developed view of the peripheral surface of the second-transfer roller 206, showing that filming (see hatched areas in FIG. 10B) occurs in both of the first sheet-passing region and the second sheet-passing region.

The filming regions are raised from the peripheral surface of the second-transfer roller 206. Therefore, due to the presence of the filming regions, the surface roughness and hardness of the second-transfer roller 206 may deviate from their appropriate ranges.

To prevent the occurrence of filming, in the present exemplary embodiment, an alternating voltage is applied to the second-transfer roller 38.

Figure 4A:
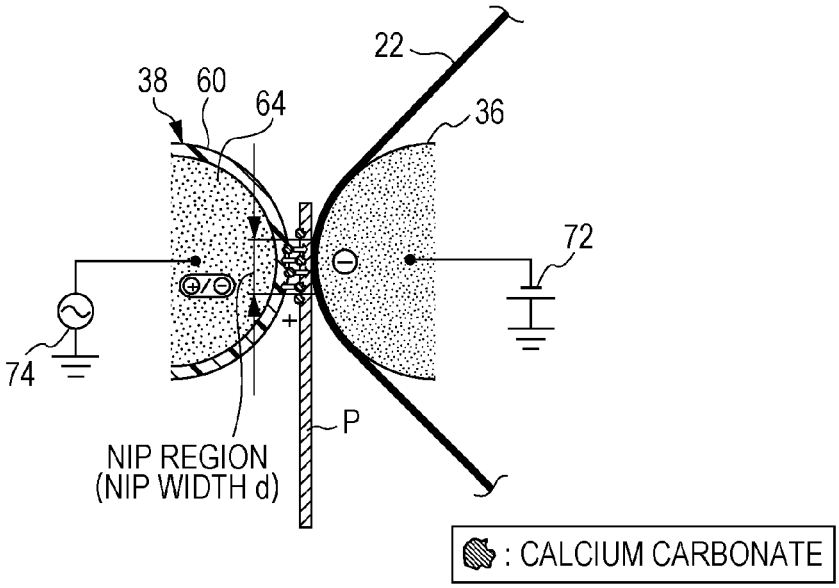
FIGS. 4A and 4B illustrate movement of calcium carbonate due to the potential difference between a second-transfer roller and a backup roller according to the present exemplary embodiment, FIG. 4A showing the second-transfer section when a recording sheet starts passing through the second-transfer section, and FIG. 4B showing the second-transfer section when the recording sheet finishes passing through the second-transfer section.
Figure 4B:
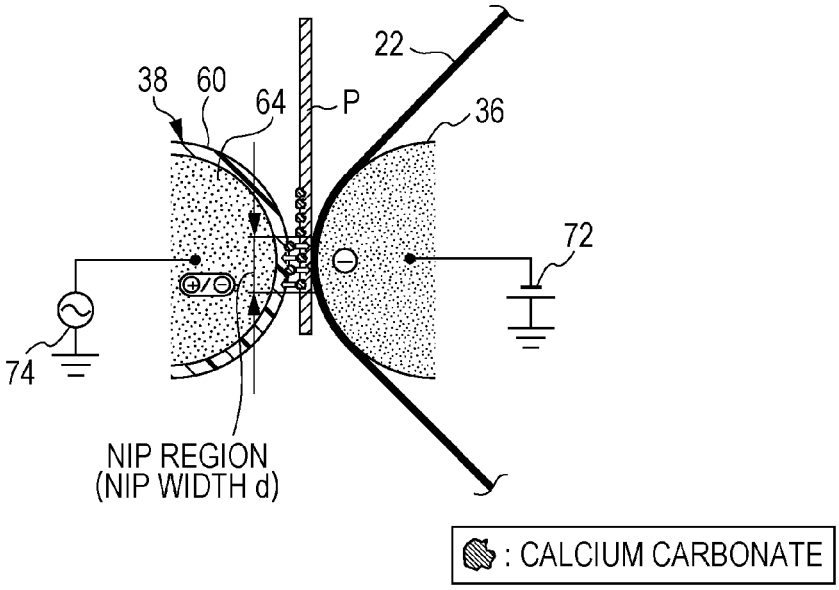

Referring to FIGS. 4A and 4B, the principle behind prevention of occurrence of filming by applying an alternating voltage to the second-transfer roller 38 according to the present exemplary embodiment will be described.

Referring to FIG. 4A, in the second-transfer section T2, when a recording sheet P is inserted into the nip between the intermediate transfer belt 22 and the second-transfer roller 38, due to friction between the second-transfer roller 38 and the recording sheet P, calcium carbonate is moved mechanically from the recording sheet P toward the second-transfer roller 38.

However, when the alternating voltage is applied to the second-transfer roller 38, the polarity of the potential of the second-transfer roller 38 becomes the same as that of the calcium carbonate, and the calcium carbonate is moved from the second-transfer roller 38 to the recording sheet P by a force of repulsion. Because the alternating voltage is applied, the calcium carbonate vibrates (reciprocates) between the second-transfer roller 38 and the recording sheet P due to the oscillation of the alternating voltage.

As the calcium carbonate vibrates in the nip width between the second-transfer roller 38 and the recording sheet P, the force of adhesion of the calcium carbonate to the second-transfer roller 38 is reduced.

Because the force of adhesion of calcium carbonate to the second-transfer roller 38 is reduced, the calcium carbonate, which might cause filming as illustrated in FIG. 8A to FIG. 10B, does not reach the cleaning blade 62. Therefore, occurrence of filming on the peripheral surface of the second-transfer roller 38 is prevented.

Evaluation of Filming Reducing Effect

Figures 5A, 5B:
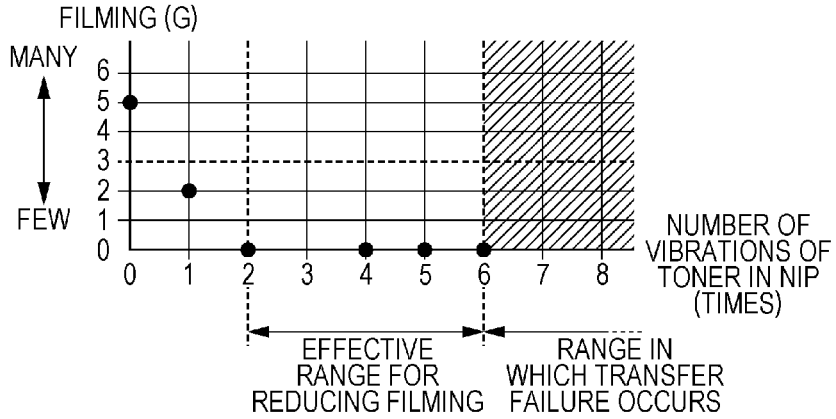
FIGS. 5A and 5B illustrate an exemplary experiment performed to examine occurrence of filming in the second-transfer section according to the present exemplary embodiment, FIG. 5A showing a characteristic graph representing the evaluation on the frequency of occurrence of filming for various number of vibrations, and FIG. 5B showing a table representing the evaluations of occurrence of filming for various combinations of voltages that may be applied to the second-transfer roller and to the backup roller according to the present exemplary embodiment, including comparative examples.

FIG. 5A is a characteristic graph in which the evaluation on the frequency of occurrence of filming is plotted against the number of vibrations (the number of reciprocations) of calcium carbonate when the alternating voltage is applied to the second-transfer roller 38.

The occurrence of filming is graded from G0 to G6. The grade G0 indicates that filming occurs least frequently (for example, filming does not occur), and the grade G6 indicates that filming occurs most frequently.

As shown in FIG. 5A, when the number of vibrations (the number of reciprocations) due to the application of the alternating voltage is 0, that is, when no countermeasures are taken, filming occurs and the evaluation is G5.

When the number of vibrations (the number of reciprocations) is 1, the evaluation is G2, which is in an appropriate range if the target grade is, for example, lower than G3.

When the number of vibrations (the number of reciprocations) is in the range of 2 to 6, the evaluation is G0, showing that filming does not occur and the application of the alternating voltage has the maximum effect.

In a case where the number of vibrations (the number of reciprocations) is greater than 6, failure in transfer of toner in an image forming operation may occur, regardless of whether filming is reduced. Therefore, such a case is excluded from the evaluation.

From the above results, the appropriate range of the number of vibrations (the number of reciprocations) for suppressing transfer and adhesion of calcium carbonate to the second-transfer roller 38 is 1 to 6 (if target value≤G2) and desirably 2 to 6 (if target value=G0).

FIG. 5B is a table showing the evaluations on occurrence of filming for various combinations of an alternating voltage and a direct-current voltage that may be applied to the second-transfer roller 38 and the backup roller 36.

In FIG. 5B, the combination used in the present exemplary embodiment is a combination of application of a direct-current voltage to the backup roller 36 and application of an alternating voltage to the second-transfer roller 38.

As shown in FIG. 5B, the evaluation of an existing structure, in which the combination of "voltage applied to the backup roller 36" and "voltage applied to the second-transfer roller 38" is "DC" and "GND", is G5. In contrast, the evaluation of the structure of the present exemplary embodiment, in which the combination of "voltage applied to the backup roller 36" and "voltage applied to the second-transfer roller 38" is "DC" and "AC", is G0.

Modification

Figure 6:
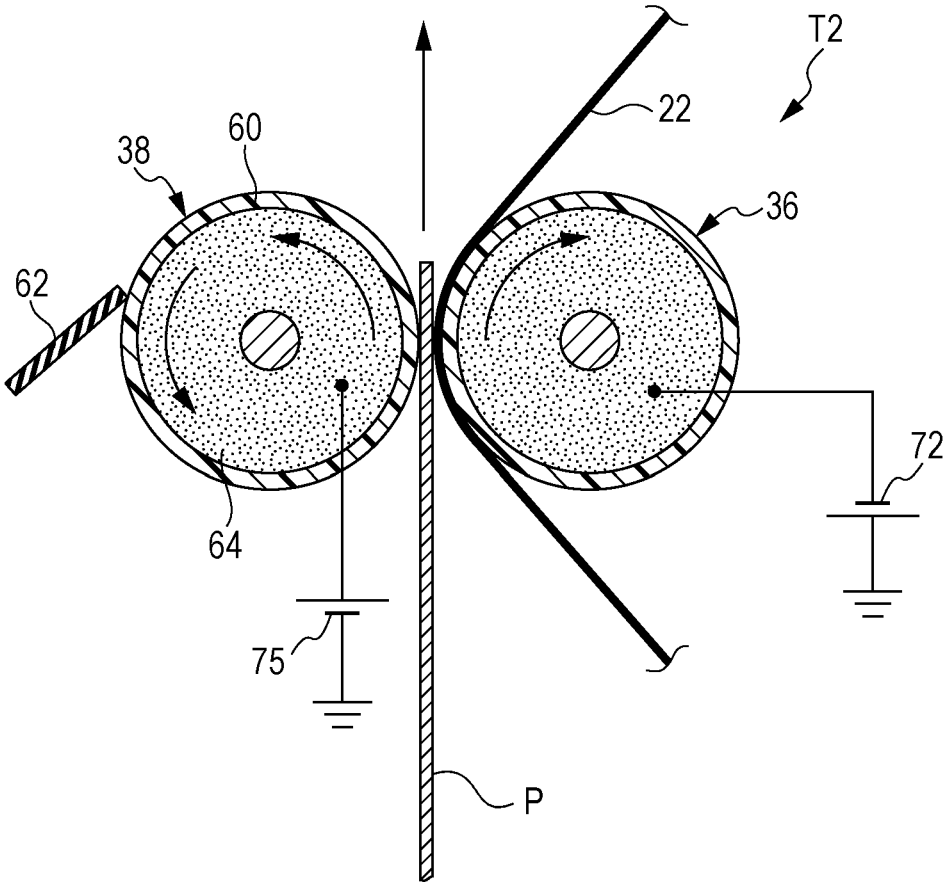
FIG. 6 is an enlarged view of the structure of a second-transfer section according to a modification of the present exemplary embodiment, in which DC voltages having opposite polarities are applied to the second-transfer roller and the backup roller.

In the present exemplary embodiment, as shown in FIG. 3, the combination of "voltage applied to the backup roller 36" and "voltage applied to the second-transfer roller 38" is "DC" and "AC" (see FIG. 5B). Alternatively, as shown in FIG. 6, a direct-current voltage (relatively negative) may be applied to the backup roller 36 from the direct-current power source 72 and a direct-current voltage (relatively positive) may be applied to the second-transfer roller 38 from a direct-current power source 75. In this case, the combination of "voltage applied to the backup roller 36" and "voltage applied to the second-transfer roller 38" is "DC" and "DC".

That is, as shown in FIG. 5B, when the combination of "voltage applied to the backup roller 36" and "voltage applied to the second-transfer roller 38" is "DC" and "DC", the evaluation is G1 or G2. Thus, this combination is more likely to achieve the target value (≤G1) than the existing structure, in which the combination of "voltage applied to the backup roller 36" and "voltage applied to the second-transfer roller 38" is "DC" and "GND" and the evaluation of which is G5.

Figure 7A:
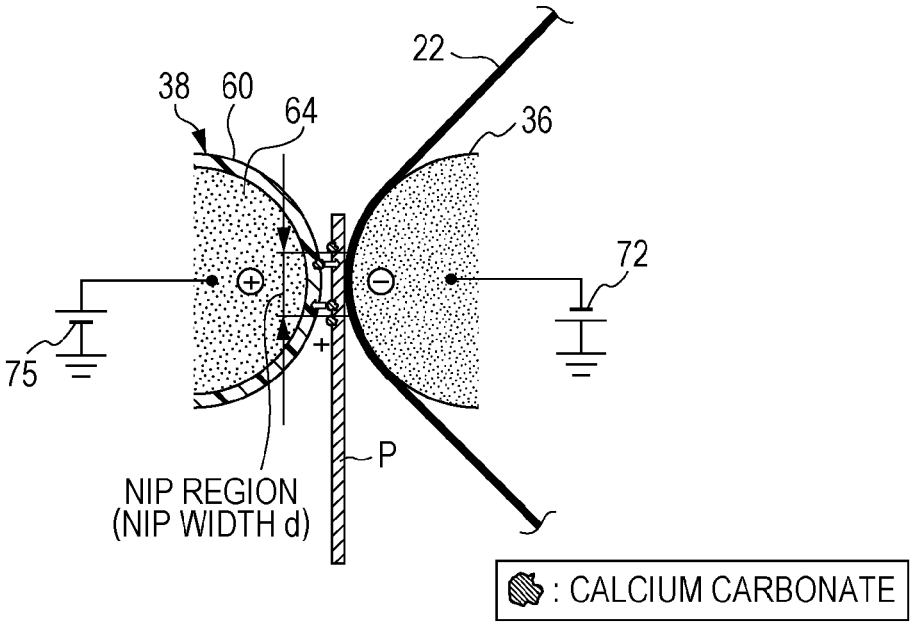
FIGS. 7A and 7B illustrate movement of calcium carbonate due to the potential difference between the second-transfer roller and the backup roller according to the modification of the present exemplary embodiment having the structure shown in FIG. 6, FIG. 7A showing the second-transfer section when a recording sheet starts passing through the second-transfer section, and FIG. 7B showing the second-transfer section when the recording sheet finishes passing through the second-transfer section.
Figure 7B:
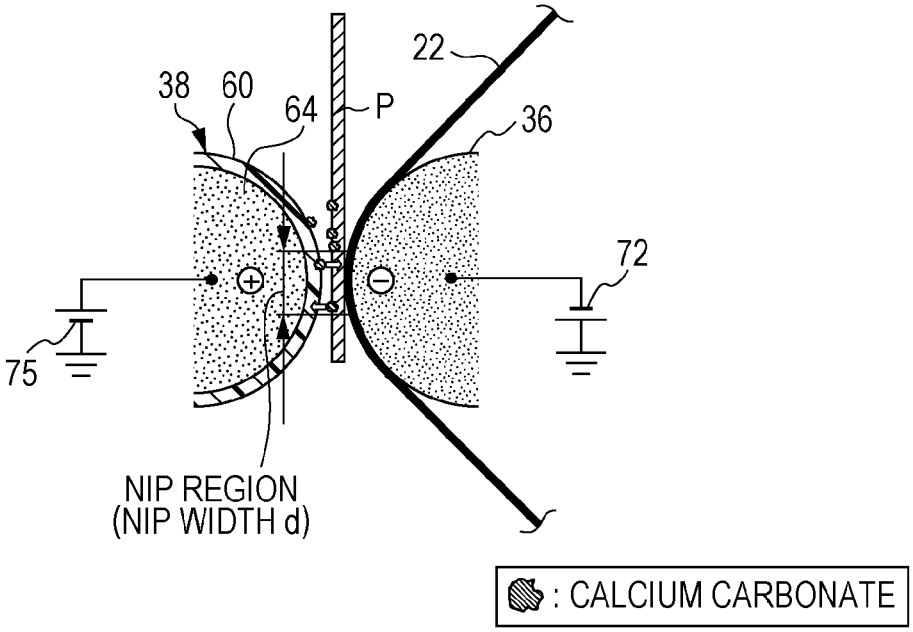

Accordingly, if the target value is G2 or less, as shown in FIGS. 7A and 7B, movement of calcium carbonate may be offset (mechanical movement is electrically prevented) by making the combination of "voltage applied to the backup roller 36" and "voltage applied to the second-transfer roller 38" be "DC" and "DC".

The foregoing description of the present exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer device comprising:

a transfer unit including an image carrier that carries a toner image to be transferred to a transfer surface of a recording medium, a transfer member disposed on a non-transfer-surface side of the recording medium and including a roller body made of an elastic material, and a resin film that covers a periphery of the roller body and has a hardness lower than a hardness of the opposing member, and a surface roughness Rz of 0.2 μm or less, and an opposing member disposed opposite the transfer member with the image carrier therebetween;

a scraping member that scrapes adhering matter from a surface of the transfer member by contacting the surface thereof;

a first application unit that applies a voltage, for transferring the toner image, to the opposing member; and a second application unit that applies to the transfer member a voltage having a polarity opposite to a polarity of the voltage applied by the first application unit.

2. The transfer device according to claim 1, wherein the voltage applied by the second application unit is an alternating voltage that is biased so as to have a polarity opposite to the polarity of the voltage applied by the first application unit.

3. The transfer device according to claim 1, wherein the voltage applied by the second application unit is a direct-current voltage having a polarity opposite to the polarity of the voltage applied by the first application unit.

4. The transfer device according to claim 1, wherein the adhering matter includes calcium carbonate particles.

5. An image forming apparatus comprising:

the transfer device according to claim 1;

a photoconductor on which an electrostatic latent image is formed in accordance with image data; and a developing unit that forms a toner image by developing the electrostatic latent image formed on the photoconductor, wherein the transfer device functions as a second-transfer section that transfers the toner image, which has been first-transferred to the image carrier from the photoconductor, to the recording medium.

6. A transfer device comprising:

a transfer unit including an image carrier that carries a toner image to be transferred to a transfer surface of a recording medium, a transfer member disposed on a non-transfer-surface side of the recording medium, and an opposing member disposed opposite the transfer member with the image carrier therebetween;

a scraping member that scrapes adhering matter from a surface of the transfer member by contacting the surface thereof;

a first application unit that applies a voltage, for transferring the toner image, to the opposing member; and a second application unit that applies to the transfer member a voltage having a polarity opposite to a polarity of the voltage applied by the first application unit, wherein the voltage applied by the second application unit is an alternating voltage that is biased so as to have a polarity opposite to the polarity of the voltage applied by the first application unit, and wherein a frequency of the alternating voltage applied by the second application unit is set so that a number of vibrations of toner in a nip between the image carrier and the transfer member is in a range of 2 to 6.

7. The transfer device according to claim 6, wherein the number of vibrations is determined by the frequency of the alternating voltage applied by the second application unit, the frequency being represented as follows:

$$f=(n/d)\times v \text{ (Hz)},$$

where f is the frequency; n is the number of vibrations; d is a width of the nip between the image carrier and the transfer member, which is a vibration range; and v is a movement velocity of the transfer member in the width of the nip.

* * * * *